US005606780A

United States Patent [19]

Kusano

[11] Patent Number: 5,606,780

[45] Date of Patent: Mar. 4, 1997

[54] BUTTON FOR ADJUSTING ARTICLE SIZE

[76] Inventor: Yukio Kusano, 10-5, Sanjo-machi, Aoba-ku, Sendai-shi, Miyagi-ken, Japan

[21] Appl. No.: 623,516

[22] Filed: Mar. 28, 1996

Related U.S. Application Data

[63] Continuation of Ser. No. 113,834, Aug. 30, 1993, abandoned, which is a continuation-in-part of Ser. No. 114,328, Aug. 30, 1993, Pat. No. 5,426,828.

[30] Foreign Application Priority Data

Oct. 22, 1992 [JP] Japan ..... 4-284545

[51] Int. Cl.[6] ..... A44B 1/30

[52] U.S. Cl. ..... 24/105; 2/265; 24/113 MP

[58] Field of Search ..... 24/105, 707.6, 24/573.1, 114.9, 113 MP, 453; 2/124, 126, 129, 265, 266, 269

[56] References Cited

U.S. PATENT DOCUMENTS

| | | | |
|---|---|---|---|
| 1,045,737 | 11/1912 | Paradis | 2/126 |
| 1,066,219 | 7/1913 | Paradis | 2/126 |
| 1,147,155 | 7/1915 | Farlow | 2/126 |
| 1,212,047 | 1/1917 | Gibson | 24/105 |
| 1,489,936 | 4/1924 | Eubank | 2/124 |
| 1,510,089 | 9/1924 | Kellog | 24/105 |
| 1,606,920 | 11/1926 | Bornstein | 24/573.1 X |
| 1,619,706 | 3/1927 | Coates | 24/105 |
| 2,045,157 | 6/1936 | Mathias | 24/573.1 X |
| 2,148,851 | 2/1939 | Bellome | 2/269 X |
| 2,245,403 | 6/1941 | Jydstrup | 24/105 |
| 3,715,781 | 2/1973 | Salvatori | 24/114.9 |

FOREIGN PATENT DOCUMENTS

| | | | |
|---|---|---|---|
| 11548 | 9/1885 | United Kingdom | 24/113 MP |
| 26903 | 12/1897 | United Kingdom | 24/105 |
| 26564 | of 1898 | United Kingdom | 24/113 MP |

*Primary Examiner*—James R. Brittain

*Attorney, Agent, or Firm*—Brooks Haidt Haffner & Delahunty

[57] ABSTRACT

Button and slit arrangements for adjusting the size of a cloth article or the like, particularly characterized in that the joined size of the article is made variable by using one or more dismountable/remountable buttons so as to achieve the size corresponding to its use. A plurality of aligned slits are formed on at least one of the joining portions of the article and a dismountable/remountable button is attached through a slit in one portion and through a selected one of the slits in the other portion to make variable the joined size of the joining portions, thereby desirably determining the size of a garment, a tent, a construction sheet, a cover for cars, etc., which is regarded as an article.

6 Claims, 7 Drawing Sheets

BUTTON FOR ADJUSTING ARTICLE SIZE

This application is a continuation, of application Ser. No. 08/113,834, filed Aug. 30, 1993, abandoned, which is a continuation-in-part of application Ser. No. 08/114,328, filed Aug. 30, 1993, now U.S. Pat. No. 5,426,828.

BACKGROUND OF THE INVENTION

1. Field of the Invention

The present invention relates to methods of adjusting article size and to the article and, more particularly, relates to a novel improvement in adjusting the size according to its use by using dismountable/remountable buttons and slits to make variable the joined size of the joined portions thereof.

2. Description of the Related Art

Conventionally, though not shown, joining of ordinary articles at the joining portions of a shirt, a suit, trousers or the like is effected such that a button fixed by means of a thread on one of the joining portions is joined with a slit on the other joining portion. Further, covers for a car, tents, sheets to be used in construction work, tablecloth, etc., respectively regarded as articles have been assorted by their size and products in various sizes have been made available.

Since the conventional articles are constructed as described, there have been the following problems.

Specifically, finished products by various sizes have been made in the case of an article of clothing such as a suit, a shirt, trousers, where all the buttons are fixed by means of threads and assortments of color, design and size have been made. For this reason, a very large number of items must be maintained as an inventory. Only a limited number of the items are actually sold and a large number of items remain as an unsold inventory.

Further, for example, in the case of clothes for infants or toddlers, since an infant or toddler grows fast where his/her clothes become too small only after six months or so, a new item of the next size is likely to be bought. In this cases, too, it is more likely that buttons and holes do not fit each other while the size of the clothes still fits, resulting in a wasteful expense. Furthermore, in the case of an article such as a cover for cars, a tent, a sheet to be used in construction work, tablecloth, etc., since they are assorted by size, they must be bought as a new item whenever their size is to be changed.

SUMMARY OF THE INVENTION

To solve the above described problems, it is an object of the present invention to provide a method of adjusting article size and the article in which the size of the article is changed by using dismountable/remountable buttons and slits to make variable a joined size of joining portions thereof.

Accordingly, a method of adjusting article size is provided in accordance with the present invention, in which a slit is formed on at least one of joining portions that are counterparts to each other and a dismountable/remountable button is attached through this slit to make variable the joined size of the joining portions.

In one aspect of this method, said slit is made on each of the joining portions.

In another aspect, said joining portions constitute a part of a garment.

In the method of adjusting article size according to the present invention, a slit is formed on a first tongue portion which is formed on one of the joining portions of the collar of a shirt and a dismountable/remountable button is provided on a second tongue portion on the other joining portion to make variable the joined size of the joining portions.

In the article size adjusting method according to the present invention, a first tongue is formed on one of joining portions of trousers constituting an article and a slit is formed on the other joining portion of the trousers, and a dismountable/remountable button is provided on the first tongue to make variable the joined size of the joining portions.

In the article size adjusting method according to the present invention, a slit is formed on one of joining portions of a sleeve constituting an article and a dismountable/remountable button is provided on the other joining portion of said sleeve, to make variable the joined size of said joining portions.

An article according to the present invention comprises: a slit formed on any of joining portions that are counterparts to each other; a dismountable/remountable button provided on any of said joining portions; and said button comprises a pin screw having a button head portion and a pin portion and a nut threaded onto said pin screw.

In an article according to the present invention, said slit may be formed on each of said joining portions.

In particular, said joining portions may be a part of a garment.

In particular, said joining portions may be a part of a cover for cars.

In particular, said joining portions may be a part of a tent.

In particular, said joining portions may be a part of a sheet to be used in construction work.

In particular, said joining portions may be a part of a tablecloth.

In the article size adjusting method and the article according to the present invention, a slit is formed on one joining portion of the joining portions that are counterparts to each other and a dismountable/remountable button is provided on the other joining portion, and the position of this button may be changed at will to make variable the size between the joining portions.

Further, in the case where a slit is formed on each of the joining portions, the joining portions may be arranged in a manner of the left side under the right or the right side under the left, where, by mounting a dismountable/remountable button in accordance with such arrangement, the joining portions may serve as a part of for example both a garment for men and a garment for women.

Furthermore, the size may be made variable in a similar manner as described with respect to a portion of trousers or a sleeve. Moreover, a cover for cars, a tent, a sheet to be used in construction work, a tablecloth, etc., may be made into a desired size by mounting a button in a dismountable/remountable manner to a desired joining portion thereof,

DESCRIPTION OF THE PREFERRED EMBODIMENTS

A description will now be Given by way of the accompanying drawings with respect to the method of adjusting article size and some preferred embodiments of the article according to the present invention.

Embodiment 1

Figure 1:
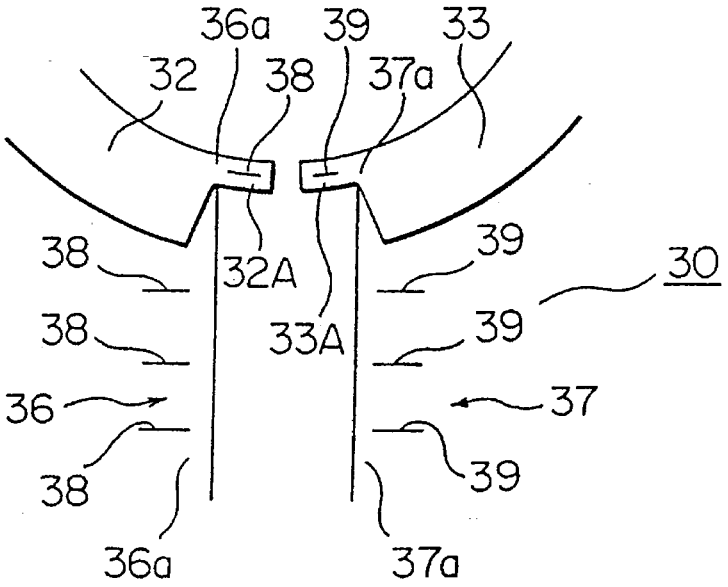
FIG. 1 shows the construction of a garment as an article according to the present invention.

Referring to FIG. 1, denoted by numeral 30 is an upper Garment such as a jacket of a suit or a shirt which constitutes an article. A first tongue portion 32A and a second tongue portion 33A are formed integrally with a first joining portion 36*a* and a second joining portion 37*a*, respectively, of a pair of collar portions 32, 33 of the upper Garment 30, the tongue portions 32A, 33A having slits 38, 39, respectively, thereon. Further, a first joining portion 36*a* and a second joining portion 37*a* of front vertical portions 36, 37 have stitched slits 38, 39, respectively, formed thereon.

Accordingly, in the construction of FIG. 1, the upper garment 30 for men may be obtained by mounting a dismountable/remountable button 20 to be described later on the first tongue portion 32A of the tongue portions 32A, 33A and by mounting buttons 20 on the first joining portion 36*a*. Further, the upper garment 30 for women may be obtained by attaching them oppositely. Furthermore, since the button 20 is dismountable/remountable as will be described, the joined size of the joining portions 36*a*, 37*a* may be made variable at will by desirably choosing the mounting position of the button 20 to be mounted on one of the joining portions 36*a* or 37*a* and on one of the tongue portions 32A or 33A by attaching this button to one of the slits 38, 39. Moreover, by providing a plurality of slits 38, 39 at desired positions, the size of each attaching portion 36*a*, 37*a* may be changed.

Embodiment 2

Figure 2:
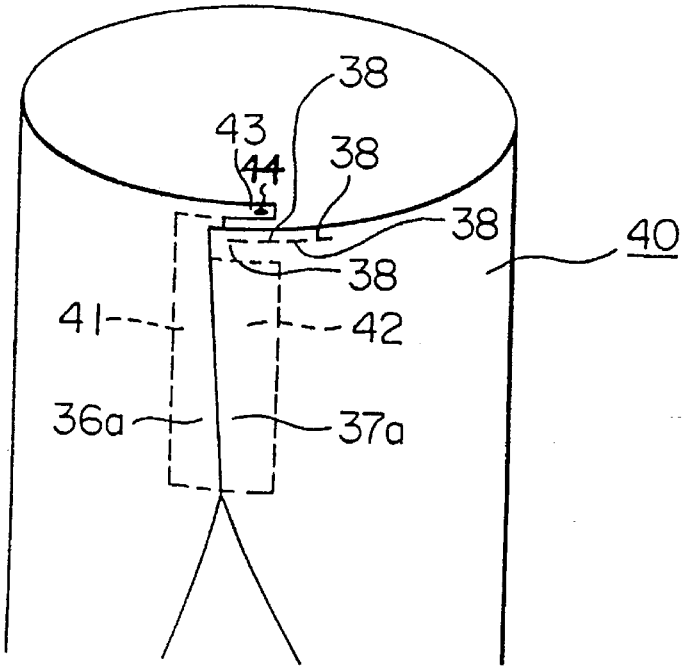
FIG. 2 shows the construction of trousers as an article.

Referring to FIG. 2, numeral 40 denotes trousers which constitute an article. A fastener 41, 42 is provided on first and second joining portions 36*a*, 37*a* of the trousers 40. A dismountable/remountable button 20 to be described later is mounted in the slit 44 on a tongue portion 43 formed on the first joining portion 36*a*.

A plurality of slits 38 are formed in the circumferential direction on the second Joining portion 37*a* and the button 20 may be attached to a corresponding slit 38 in accordance with its mounted position, to adjust at will the size around the waist of the trousers. It should be noted that, while the overlapping portion of the fastener 41, 42 must be enlarged, it is also possible to provide a plurality of fasteners 41, 42 so as to use them according to the size.

Embodiment 3

Figure 3:
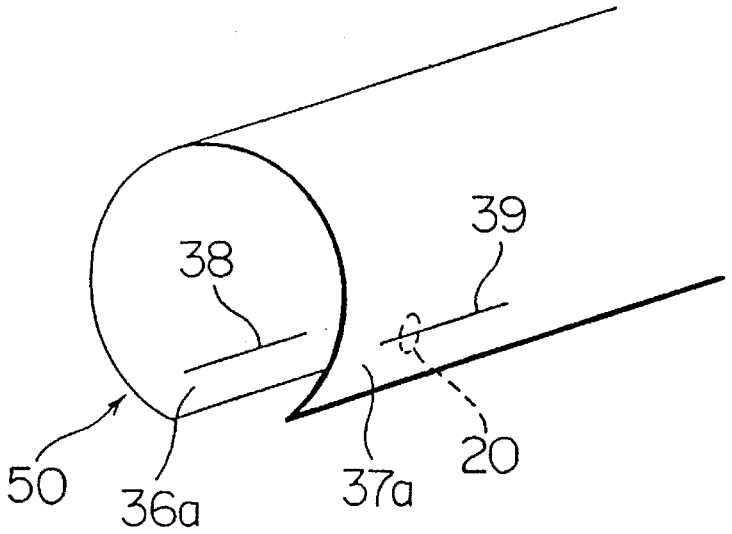
FIG. 3 shows the construction of a sleeve portion as an article.
Figure 4:
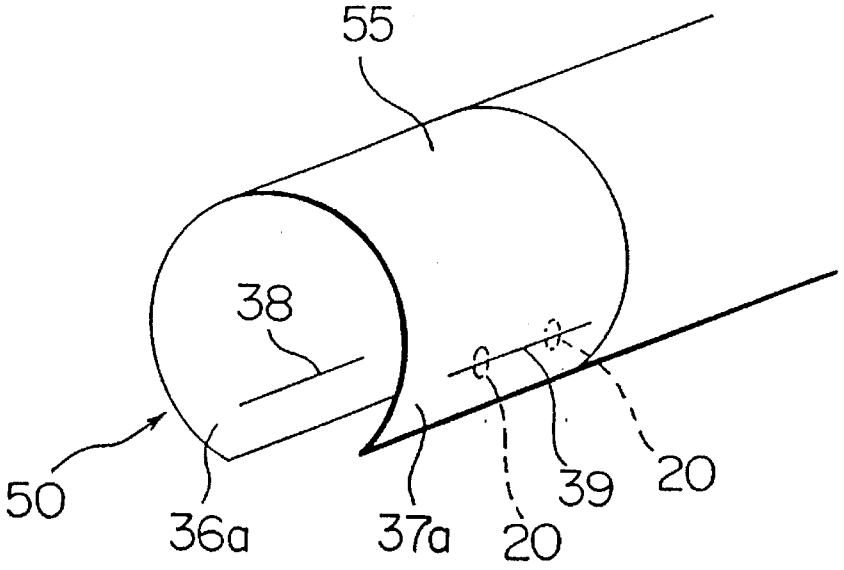
FIG. 4 shows the construction of a sleeve portion as an article.

Slits 38, 39 are longitudinally formed on joining portions 36*a*, 37*a* of a sleeve 50 of an upper garment or a shirt or the like constituting an article as shown in FIGS. 3 and 4, and the position of a button 20 may be moved along the slit or the plurality of slits 38, 39 to adjust the position of the button.

Further a double sleeve 55 is provided in the construction of FIG. 4, and the length thereof may be adjusted.

Figure 5:
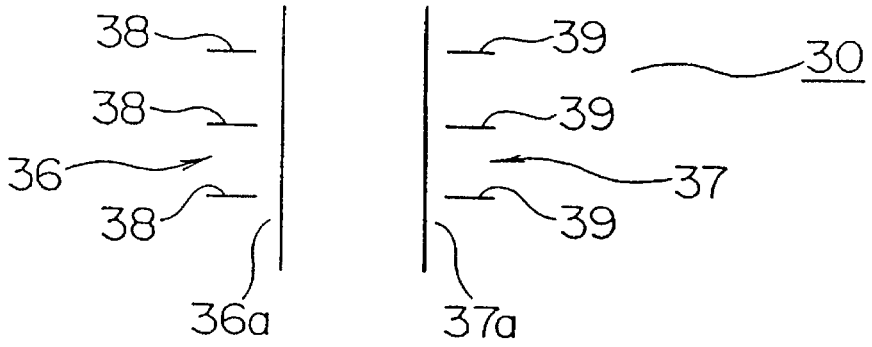
FIG. 5 shows the construction of a sheet as an article.

A description will now be given with respect to the cases of indoor and outdoor tents, a cover for cars, a tablecloth, a sheet to be used in construction work, a cover for machinery, etc., which forms an article as shown in FIG. 5.

Referring to FIG. 5, denoted by numeral 30 is a sheet of an indoor or outdoor tent, a cover for cars, a tablecloth, a cover for construction work, a cover for machinery or the like which constitutes an article. Slits 38, 39 are formed on a pair of first joining portion 36*a* and a second joining portion 37*a* of the sheet 30 and are stitched by means of thread.

Accordingly, the joining portions 36*a*, 37*a* in the construction of FIG. 5 are joined with each other by mounting a button 20 which will be described later. The joined size of the joining portions 36*a*, 37*a* may be made variable at will by attaching the button 20 to one of the slits 38, 39. That is, the above described joining portions 36*a*, 37*a* are provided at a portion of a tent, a cover for cars, a tablecloth, a construction sheet or the like, to make changeable the area or volume thereof as a whole, thereby making possible to desirably change its size.

Figure 6:
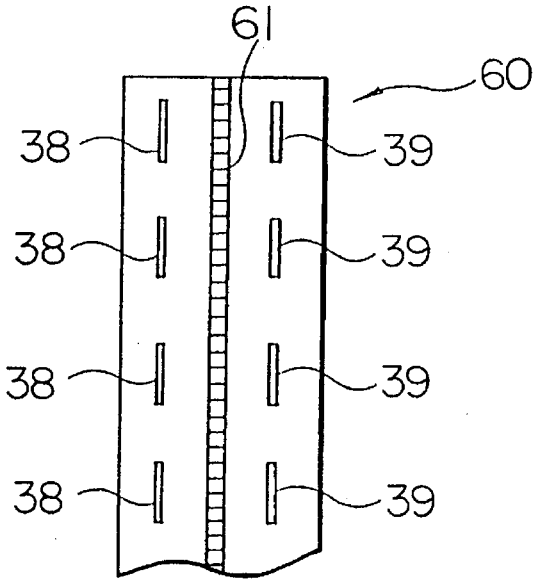
FIG. 6 shows the construction of another embodiment.
Figure 7:
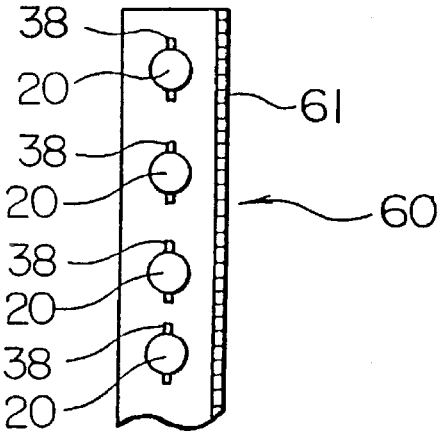
FIG. 7 shows the closed state of FIG. 6.
Figure 8:
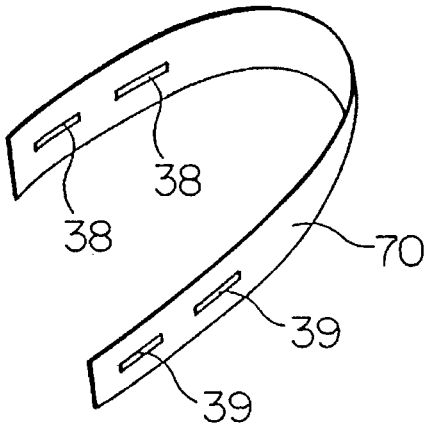
FIG. 8 shows the construction of another embodiment
Figure 9:
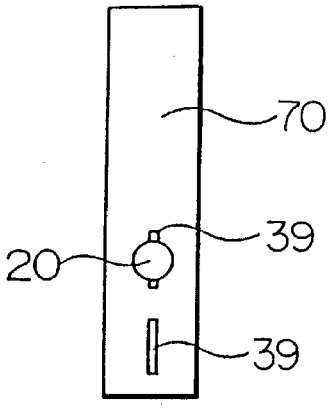
FIG. 9 shows the closed state of FIG. 8.
Figure 10:
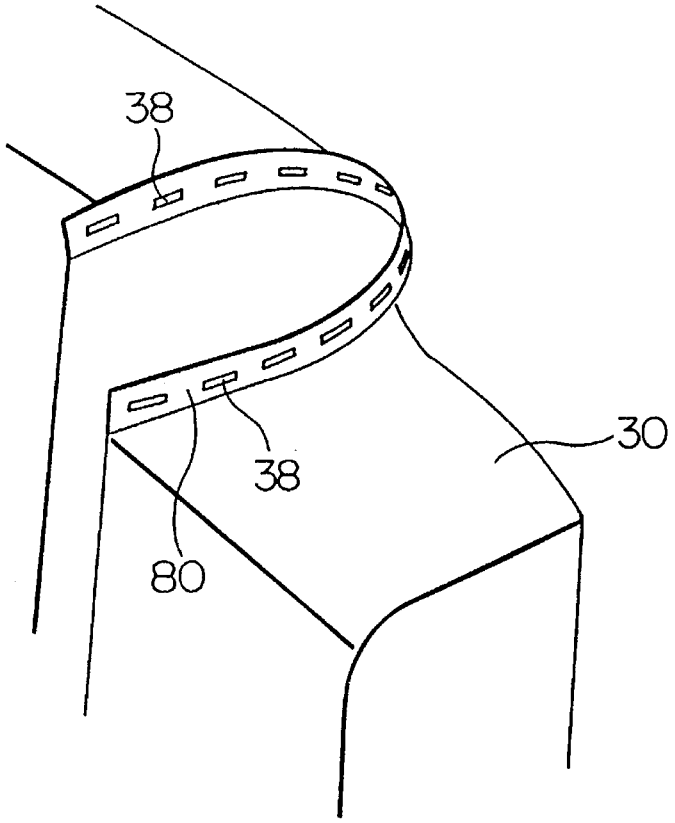
FIG. 10 is a perspective view showing another embodiment of a garment.
Figure 11:
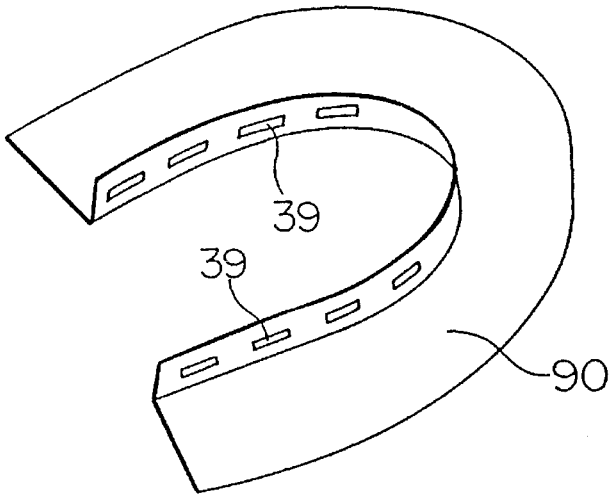
FIG. 11 is a perspective view showing a collar to be attached to the garment of FIG. 10.

Further, slits 38, 39 are formed on the both sides of a fastener portion 61 of a fastener 60 provided as shown in FIG. 6 for example on a garment and slits 38, 39 are joined with each other as shown in FIG. 7 by means of buttons 20. In this manner it is possible to provide joining of a jumper, trousers, a sweater or the like when the fastener 60 fails to function and to make an adjustment for reducing the size thereof. Further, by putting a button 20 through slits 38, 39 at desired positions formed on the two sides of a strip 70 to be used in a garment or the like as shown in FIGS. 8 and 9, the length of the strip 70 may be changed at will. Furthermore, as shown in FIG. 10, a plurality of slits 38 are formed on a stand collar 80 of an upper garment 30 and a collar 90 having slits 39 is provided in a dismountable/remountable manner on the stand collar 80 by means of buttons 20, thereby change for a new article and a change in size may be achieved by changing the collar 90.

FIGS. 12~16 show the construction of the above described button 20.

Figure 12:
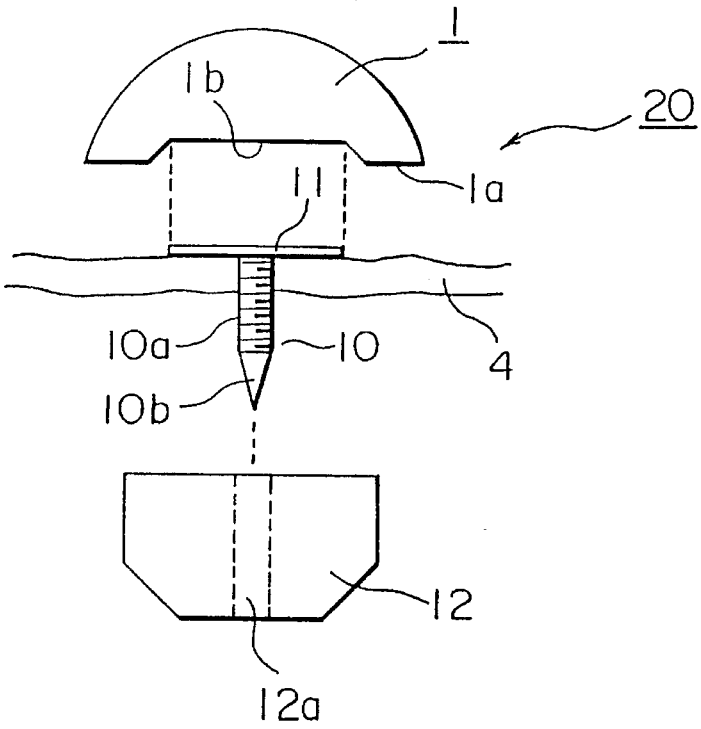
FIG. 12 is an exploded view showing a button for a garment according to the present invention.

Referring to FIG. 12, denoted by numeral 1 is a button head portion having an internal gap and being integrally formed by means of caulking or the like. A flange 11 having a pin screw 10 integrally formed thereon is Joined with and connected integrally to a concave portion 1*b* formed on the bottom portion 1*a* of the button head portion 1 (since FIG. 6 is an exploded view, they are shown in separated manner).

The above screw pin 10 is constructed by forming a screw portion 10*a* and a pin portion 10*b* integrally with each other and a nut 12 is threaded onto the pin screw 10 through a threaded hole 12*a*.

Thus, when the button 20 according to the construction of FIG. 12 as described is to be made, the flange 1 is integrally joined with the button head portion 1 by means of such joining means as welding, bonding or soldering and it is completed by threading the nut 12 onto the pin screw 10.

Further, when the button 20 according to the construction of FIG. 12 as described is actually mounted on a garment 4, mounting is completed such that the pin screw 10 is put into the garment 4 and the nut 12 is threaded onto the screw portion 10*a* extended from the garment 4 which is regarded as an article.

It should be noted that, by desirably changing diameter and thickness of the flange 11, a clearance may be set between the button head 1 and the garment 4 as the article.

Figure 13:
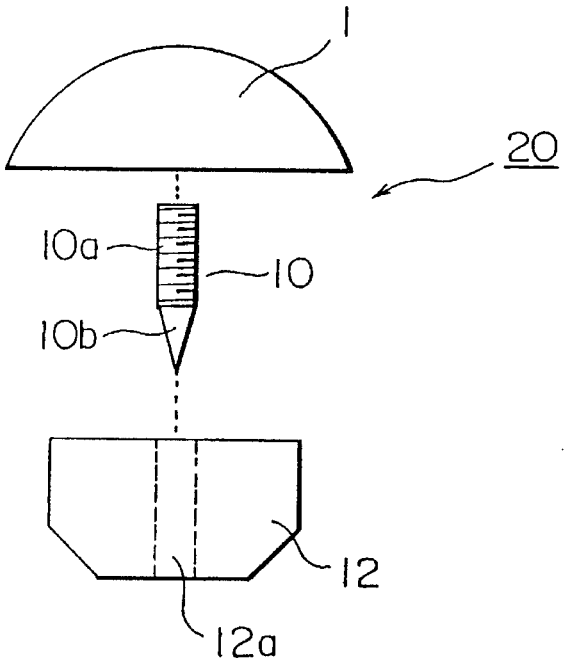
FIG. 13 is an exploded view showing another embodiment different from FIG. 12.

In the case of a construction as shown in FIG. 13, it is also possible to directly connect the pin screw 10 to the button head portion 1 without using the flange 11 as described. Accordingly, as is apparent from Embodiments 1 and 2, the pin screw 10 and the button head portion 1 may be connected to each other with or without the flange 11.

Figure 14:
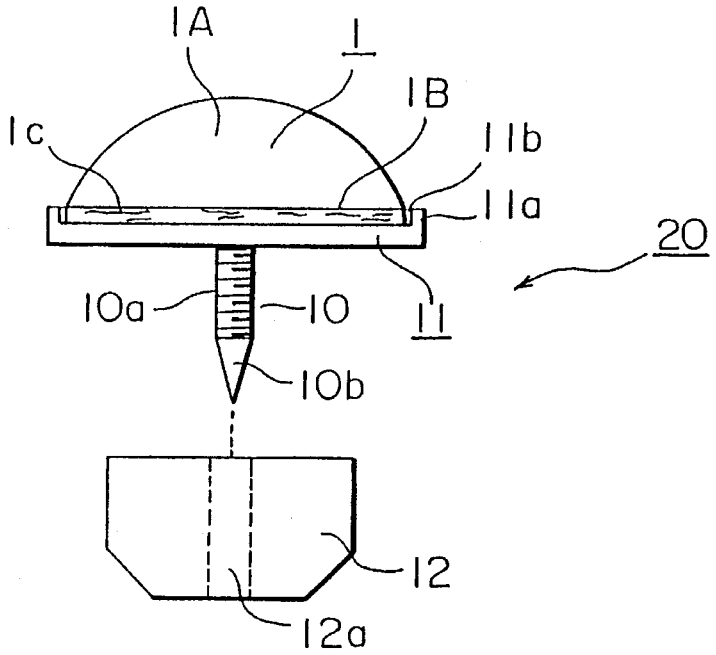
FIG. 14 is an exploded view showing another embodiment different from FIG. 12.

In the case of a construction as shown in FIG. 14, a rise 11*a* is formed on the outer periphery of the flange 11 and a screw portion 1*c* of a button receiver 1B of a button ornamental portion 1A of the above described button head portion 1 is threaded in a dismountable/remountable manner into an inner thread 11*b* of the rise 11*a*. The button ornamental portion 1A of the button head portion 1 may be desirably changed on the flange 11.

Figure 15:
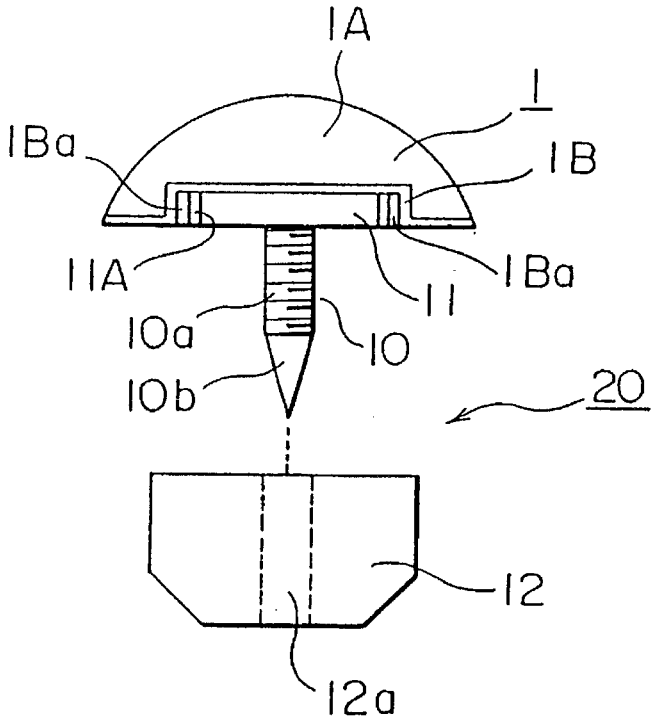
FIG. 15 is an exploded view showing another embodiment different from FIG. 12.

In the case of a construction as shown in FIG. 15, the button head portion 1 is constructed by the button ornamental portion 1A and the button receiver 1B and an outside screw 11A of the flange 11 is threaded onto a threaded portion 1Ba formed on the button receiver 1B. Thus, the button ornamental portion 1A may be desirably changed on the flange 11.

Figure 16:
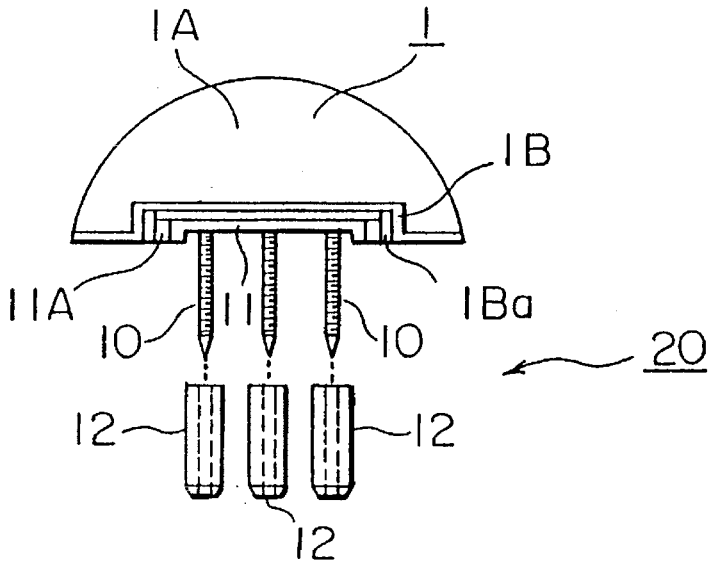
FIG. 16 is an exploded view showing another embodiment different from FIG. 12.

In the case of a construction as shown in FIG. 16, in order to make smaller the through hole at the time of penetrating through the garment 4 as the article by making smaller the diameter of the pin screw 10 to be provided on the flange 11 than that of the above described constructions, a plurality of pin screws 10 are provided and a plurality of nuts 12 are used to mount it on the garment 4 as the article.

It should be noted that the above embodiments have been described as typical examples and, naturally, all the constructions in which the button head portion 1 and the pin screw 10 are connected to each other and are fixed by means of the nut 12 are included in the scope of the present invention. Further, though not shown, the above described button head portion 1 may: have an internal scenting portion for providing a scent; be internally provided with an aluminum ball serving as a bell; or be internally provided with an LED serving as a light emitting portion.

Since the article size adjusting method and the article according to the present invention are constructed as has been described, the following advantages may be obtained.

That is, since a slit is formed and a dismountable/remountable button is provided on the joining portions of a jacket or a shirt or the like as an article, the joined size thereof may be desirably adjusted and their setting for men or women may be achieved at will by providing them on each of the joining portions, and it is possible to provide clothes for a user, without maintaining a huge inventory which has conventionally been necessary. Further, in the case of sleeves, the lengths thereof may adjusted at will, whereby sizes of the assortment equivalent to those of the conventional inventory may be achieved by a smaller number of sizes than the conventional case.

Furthermore, since the buttons may be mounted on and dismounted from a garment without using thread, the mounting of buttons is greatly facilitated.

Moreover, since the buttons may be easily mounted and dismounted, it is possible to bring clothes without their buttons to the cleaners whereby damage to the buttons may be completely avoided. Further, in the case where the present invention is applied to various tents, a cover for cars, a tablecloth, a sheet to be used in construction work, etc., the size thereof may be desirably adjusted.

Further, since it is possible to change only the button ornamental portion, restoring of buttons on the clothes as new ones may be effected easily and at a low cost when their surfaces become degraded due to age.

Further, since such buttons may be easily mounted and dismounted, it is not necessary to keep a large inventory of various types such as of clothes, shirts, various types of covers the tents, and mounting of buttons or the setting of a size may be effected according to each customer's preference, whereby the inventory or the like may be greatly reduced.

What is claimed is:

1. A cloth article or the like having overlapping portions sizably adjustable with respect to each other by a button assembly detachably secured therethrough, a first of said overlapping portions having means defining at least one slit therethrough, and a second of said overlapping portions having means defining a plurality of aligned and spaced apart slits therethrough, said button assembly being detachably secured through one of said slits of said first overlapping portion and through any selected one of said aligned slits of said second overlapping portion, said cloth article being adjustable in size without distortion thereof by detaching said button assembly from said selected one of said aligned slits of said second overlapping portion and detachably securing said button assembly through any other selected one of said aligned slits of said second overlapping portion, and said button assembly comprising a button carrier element having an upperside surface, an underside surface, and a circular screw thread extending perpendicular to its said upperside and underside surfaces; a button head secured to said upperside surface of said button carrier element; a flange element having an upperside surface, an underside surface and a circular screw thread extending perpendicularly to its said upperside and underside surfaces and threadedly connected to said screw thread on said button carrier element; at least one pin secured to and projecting perpendicularly from said underside surface of the flange element and extending through said one slit of the first overlapping portion and through said one selected slit of the second overlapping portion; and a nut separably mounted on each said pin at a location therealong, whereby said overlapping portions of said cloth article are detachably secured to each other by said button assembly.

2. A cloth article according to claim 1, wherein said slit defining means of said first overlapping portion defines a plurality of aligned and spaced apart slits therethrough, each of said plurality of slits through said first overlapping portion respectively overlying a respective one of said plurality of slits through said second overlapping portion, said second overlapping portion having at least as many slits as said first overlapping portion, and said overlapping portions being detachably secured to each other by a plurality of said button assemblies, each of said button assemblies being detachably secured respectively through one of said overlapping slits of said first and second overlapping portions.

3. A cloth article according to claim 2, wherein each of said cloth article overlapping portions has an edge, said alignment of said plurality of slits in each said overlapping portion being in a direction parallel to its said edge, and each said slit of each said overlapping portion being elongated in a direction parallel to its said edge.

4. A cloth article according to claim 3, wherein said edge of each said overlapping portion is adjacently aligned with said edge of the other, and said plurality of button assemblies substantially corresponds in number to, and pass through the respective of said plurality of overlying slits, and which further comprises a releasable fastener attached to and between said aligned edges and releasably securing them together, said secured first and second overlapping portions projecting substantially perpendicularly outward from said cloth article and thereby reducing the size of said cloth article.

5. A cloth article according to claim 1, wherein said slit defining means of said first overlapping portion defines a plurality of aligned and spaced apart slits therethrough, said second overlapping portion having at least as many slits as said first overlapping portion.

6. A cloth article according to claim 5, wherein said cloth article is a strip of cloth having opposite ends, and said first and second overlapping portions of said cloth article are respective portions of said strip each substantially adjacent to one of said opposite ends thereof.

* * * * *

UNITED STATES PATENT AND TRADEMARK OFFICE

CERTIFICATE OF CORRECTION

PATENT NO. : 5,606,780

DATED : March 4, 1997

INVENTOR(S) : Kusano

It is certified that error appears in the above-indentified patent and that said Letters Patent is hereby corrected as shown below:

Column 3, line 31, "Garment" should read --garment--; line 35 "Garment" should read --garment--.

Column 4, line 55, "Joined" should read --joined--.

Column 6, line 13, "covers the tents, and mounting" should read --covers and the tents, and mounting of --.

Signed and Sealed this

Twenty-first Day of October 1997

*Attest:*

*Attesting Officer*

BRUCE LEHMAN

*Commissioner of Patents and Trademarks*